US007129686B1

(12) United States Patent
Huang

(10) Patent No.: US 7,129,686 B1
(45) Date of Patent: Oct. 31, 2006

(54) APPARATUS AND METHOD FOR A HIGH PSRR LDO REGULATOR

(75) Inventor: Shengming Huang, Gourock (GB)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 11/197,052

(22) Filed: Aug. 3, 2005

(51) Int. Cl.
*G05F 3/20* (2006.01)

(52) U.S. Cl. ..... 323/313; 323/314; 323/315

(58) Field of Classification Search ..... 323/313, 323/314, 315
See application file for complete search history.

(56) References Cited

U.S. PATENT DOCUMENTS

| | | | | |
|---|---|---|---|---|
| 4,160,201 | A * | 7/1979 | Ahmed | 323/226 |
| 6,249,153 | B1 * | 6/2001 | Moraveji | 327/65 |
| 6,600,439 | B1 * | 7/2003 | Pahr | 341/158 |
| 6,642,791 | B1 * | 11/2003 | Balan | 330/253 |
| 6,812,771 | B1 * | 11/2004 | Behel et al. | 327/359 |
| 7,061,706 | B1 * | 6/2006 | Conteras et al. | 360/75 |

OTHER PUBLICATIONS

Micrel Datatsheet, "MIC5305—150mA μCap Ultra-Low Dropout LDO Regulator," Rev. Dec. 2004, pp. 1-12.

Texas Instruments Datasheet, "Ultralow-Noise, High PSRR, Fast RF 200-mA Low-Dropout Linear Regulators in NanoStar™ Wafer Chip Scale and SOT23," SLVS3481—Jul. 2001, Revised May 2005, pp. 1-20.

National Semiconductor Datasheet, "LP3990—150mA Linear Voltage Regulator for Digital Applications," Sep. 2005, pp. 1-13.

* cited by examiner

*Primary Examiner*—Bao Q. Vu
(74) *Attorney, Agent, or Firm*—Darby & Darby PC; Matthew M. Gaffney

(57) ABSTRACT

A tail current source is provided. The tail current source may be used in amplifiers, in an error amplifier of an LDO, or the like, to achieve high PSRR. The tail current source includes a first current mirror, a capacitor, a resistive device, and a current mirror circuit. The current mirror circuit is operable to provide the tail current from an input current. The first current mirror is an n-type current mirror which diverts a small fraction of the DC current from the current mirror circuit. The capacitor and the resistive device are coupled in series with each other, and are coupled between VDD and the common gate node of the transistors in the n-type current mirror. Accordingly, the gates of the transistors in the first current mirror follow AC variations in VDD. This way, the effects of AC variations in VDD on the tail current are approximately cancelled.

15 Claims, 2 Drawing Sheets

APPARATUS AND METHOD FOR A HIGH PSRR LDO REGULATOR

FIELD OF THE INVENTION

The invention is related to electronic circuits, and in particular, to an apparatus and method for a tail current source that approximately cancels error due to AC variations in the power supply.

BACKGROUND OF THE INVENTION

It is desirable for voltage regulators used with portable battery-powered devices to have low output noise and a high Power Supply Rejection Ratio (PSRR). To meet these requirements in the circuit design of a regulator, it is common to use a high value of RC filter to get low noise performance for the reference voltage and thus low output noise for the regulator. High value of RC filters can be implemented via an on-chip resistor and an external bypass capacitor. The bypass capacitor can also improve PSRR at low frequency (below 10 KHz), but not high-frequency PSRR. By supplying the reference and part of the error amplifier with its own output voltage of a regulator (with Vout>1.8V), the PSRR can also be improved. This method, however, may not be used for low output voltage options (with Vout<1.8V). Also, for high frequency (over 10 KHz), the improvement in PSRR may still not be enough.

Currently, high PSRR LDO regulators, such as MIC5305 (with 150 mA maximum load from Micrel Semiconductor and claimed as the industry's highest PSRR LDO regulator) and TPS793xx (with 200 mA maximum load from TI), may offer over 70 dB PSRR with frequencies below 10 KHz. By using a 100 nF external bypass capacitor and a 1 μF output capacitor, the PSRR of MIC5305 may be 85 dB at 1 KHz, 65 dB at 10 KHz, and 48 dB at 100 KHz. If a 10 nF external bypass capacitor and a 10 μF output capacitor is used, TPS793xx may have a PSRR value of nearly 70 dB from 100 Hz to 10 KHz and 43 dB at 100 KHz.

BRIEF DESCRIPTION OF THE DRAWINGS

Non-limiting and non-exhaustive embodiments of the present invention are described with reference to the following drawings, in which.

DETAILED DESCRIPTION

Figure 1:
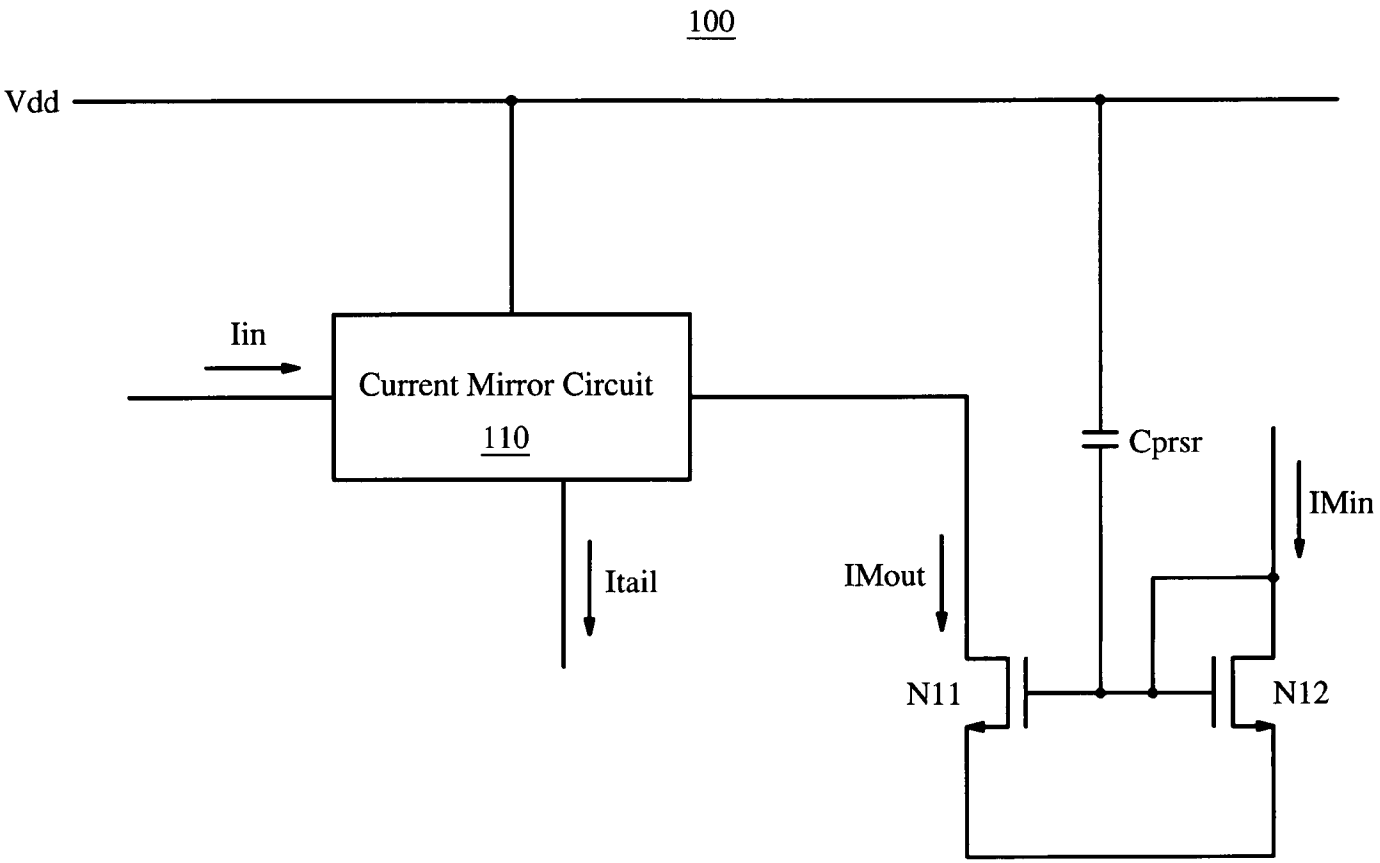
FIG. 1 shows a block diagram of an embodiment of a circuit.

Various embodiments of the present invention will be described in detail with reference to the drawings, where like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" includes plural reference, and the meaning of "in" includes "in" and "on." The phrase "in one embodiment," as used herein does not necessarily refer to the same embodiment, although it may. The term "coupled" means at least either a direct electrical connection between the items connected, or an indirect connection through one or more passive or active intermediary devices. The term "circuit" means at least either a single component or a multiplicity of components, either active and/or passive, that are coupled together to provide a desired function. The term "signal" means at least one current, voltage, charge, temperature, data, or other signal. Where either a field effect transistor (FET) or a bipolar transistor may be employed as an embodiment of a transistor, the scope of the words "gate", "drain", and "source" includes "base", "collector", and "emitter", respectively, and vice versa.

Briefly stated, the invention is related to a tail current source that may be used in amplifiers, in an error amplifier of an LDO, or the like, to achieve high PSRR. The tail current source includes a first current mirror, a capacitor, a resistive device, and a current mirror circuit. The current mirror circuit is operable to provide the tail current from an input current. The first current mirror is an n-type current mirror which diverts a small fraction of the DC current from the current mirror circuit. The capacitor and the resistive device are coupled in series with each other, and are coupled between VDD and the common gate node of the transistors in the n-type current mirror. Accordingly, the gates of the transistors in the first current mirror follow AC variations in VDD. This way, the effects of AC variations in VDD on the tail current are approximately cancelled.

FIG. 1 shows a block diagram of an embodiment of circuit 100. Circuit 100 includes current mirror circuit 110, transistors N11 and N12, and capacitor Cpsr.

In operation, current mirror circuit 110 provides tail current Itail from input current Iin. Current mirror circuit 110 includes at least one current mirror. Further, the sources of the transistors in at least one of the current mirrors in current mirror circuit 110 are coupled to power supply voltage VDD. In one embodiment, current Iin is a source current, and in another embodiment, current Iin is a sink current. If current mirror N11/N12 were not present in circuit 100, tail current Itail could vary based on the AC variations of power supply voltage VDD.

Current mirror N11/N12 is arranged to draw current IMout from the input or output of one of the current mirrors in current mirror circuit 110. The DC component of current IMout is based on current IMin, which is received at the input of current mirror N11/N12. Additionally, capacitor Cpsr is coupled between the power supply node and the gate of transistor N11. Accordingly, the voltage at the gate of transistor N11 follows AC variations in power supply voltage VDD. Thus, current IMout varies based on AC variations in voltage VDD. Accordingly, variations in current Itail due to AC variations in voltage VDD may be approximately cancelled.

Figure 2:
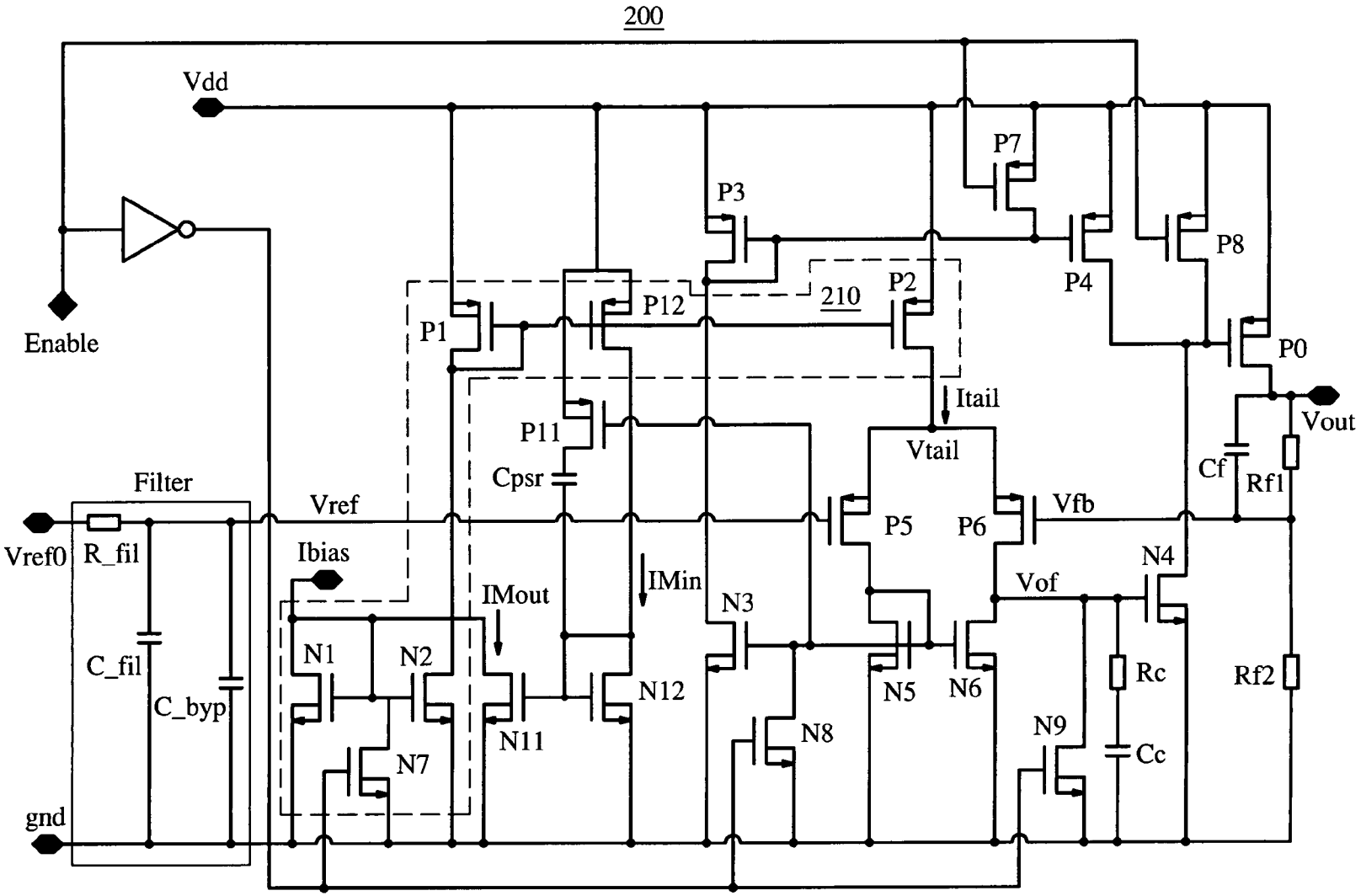
FIG. 2 schematically illustrates an embodiment of the circuit of FIG. 1, arranged in accordance with aspects of the present invention.

FIG. 2 schematically illustrates an embodiment of circuit 200, which may be employed as an embodiment of circuit 100 of FIG. 1. Circuit 200 operates as a high-PSRR low-drop out regulator (LDO). Circuit 200 may further include transistors P5, P6, N5, N6, N3, N8, N9, N4, P3, P7, and P4; capacitors Cc, Cf, C_fil, and C_byp; resistors Rc, Rf1, Rf1, and Rfil; and inverter Inv1. Current mirror circuit 210 may include transistors N1, N2, N7, P1, P2, and P12.

In one embodiment, each of the components illustrated in FIG. 2 are included on an integrated circuit except for capacitor Cbyp. Current mirror circuit 210 and transistors N11, N12, and P12 and capacitor Cpsr operate together as a tail current source. The tail current source and transistors P5, P6, N5, and N6 operate together as an input stage of an error amplifier. Additionally, transistors N3, N8, N9, N4, P3, P7, and P4; resistor Rc; and capacitor Cc act together as an output stage for the error amplifier. The error amplifier provides signal Err from reference voltage Vref and feedback voltage Vfb.

Also, transistor P0 operates as a pass transistor to provide voltage Vout from voltage Vdd responsive to error signal Err. Resistors Rf1 and Rf2 operate as a voltage divider to provide feedback voltage Vfb from output voltage Vout. Capacitor Cf is operative to reduce output noise and load transient. Further, resistor R_fil and capacitor C_fil (or C_byp if external capacitor used) form an RC filter between the original reference Vref0 and voltage reference Vref for the noninverting input of the error amplifier. C_byp is an external bypass capacitor.

If transistors N11, N12, and capacitor Cpsr were not present in circuit 200, circuit 200 would operate as follows. When an AC signal appears on Vdd in the error amplifier, due to the miller capacitance across the gate-drain of bias transistors P1 and P2, there is a lag between the gate and source potential of P1 and P2 as the AC signal rises and falls, causing current Itail thus potential Vtail at the drain of P2 to rise and fall during the positive and negative half cycles of the AC signal respectively. Output voltage Vout acts in a similar manner. However, since output capacitor Cout (not shown) may be connected at Vout to ground, the variation of Vout is much smaller than that of Vtail. Further, the bias current Ibias and thus the gate-source voltage of N2 also follows the AC signal, e.g., rises and falls repeatedly. This in turn enlarges the variation of Vtail. Accordingly, the gate-source voltage of P6 and thus the current flowing through P6 also varies due to smaller variation of Vfb than that of Vtail. Thus, first stage output voltage Vof follows the variation of Vtail. This in turn enlarges the variation of Vout as the AC signal varies. However, with transistor N11, N12, and capacitor Cpsr included in the circuit, the variation of Vout as the AC signal varies is approximately cancelled.

In one embodiment, P11 has a relatively large W/L size and operates as a resistor. In one embodiment, the W/L size of P12 is designed to be about ⅓ that of P1, the W/L size of N11 is designed to be about ⅕ of N12, and N1 and N2 have approximately identical W/L size. Therefore, in this embodiment, with the drain of N11 connected to the drain of N1, about 1/15 of Ibias will flow into N11 under DC conditions. This in turns leads to the bias current of P1 and thus the tail current of P2 being decreased by about 1/15. However, if there is an AC signal at power supply Vdd, the gate-source voltage Vgs and thus the drain current of N11 will follow the variation of the AC signal due to capacitor Cpsr (14 pF in one embodiment).

During the positive and negative half cycles of the AC signal, Vgs of N11 tends to rise and drop respectively compared to its DC value, causing the gate-source voltage of N2 to drop and rise respectively, opposing to the variation of the AC signal. Accordingly, the bias current of N2 is self-calibrated. This tends to cancel or decrease the variation of tail current of P2 or Vtail and Vof. Accordingly, variation of voltage Vout is decreased. Accordingly circuit 200 has high PSRR. An embodiment of circuit 200 may have a PSRR of over 80 dB from 100 Hz to 10 KHz, and a PSRR of 56 dB at 100 KHz with a 10 nF external bypass capacitor. Further, this high PSRR may be achieved with relatively simple additional circuitry and very small additional power consumption.

Although one embodiment of circuit 200 is shown in FIG. 2, other embodiments are within the scope and spirit of the invention. For example, although one embodiment of an error amplifier is shown in FIG. 2, a different embodiment of an error amplifier may be employed. Also, although the drain of transistor N11 is connected to the drain of transistor N1 in FIG. 2, in other embodiments, the drain of transistor N11 may instead be connected to the drain of transistor N2 or the drain of transistor P2. Further, although particular mirror ratios were discussed above, in other embodiments, mirror ratios other than those discussed above may be employed.

Additionally, although the transistors illustrated in FIG. 2 are FETs, in other embodiments, some or all of the transistors may instead be bipolar transistors, or the like. Also, although transistor P11 is illustrated in FIG. 2, in other embodiments, transistor P11 may be replaced with a resistor, or the like, or excluded from the circuit. Further, various additional components not shown in FIG. 2, for example cascode transistors, may be included in circuit 200. Also, although circuit 200 is a linear regulator with high PSRR, other embodiments may be a high-PSRR class A amplifier, class AB amplifier, class B amplifier, class D amplifier, or the like. These variations and others are within the scope and spirit of the invention.

The above specification, examples and data provide a description of the manufacture and use of the composition of the invention. Since many embodiments of the invention can be made without departing from the spirit and scope of the invention, the invention also resides in the claims hereinafter appended.

What is claimed is:

1. A circuit for high PSRR, comprising:

a current mirror circuit that is operable to provide a tail current based, in part, on an input current, wherein the current mirror circuit is coupled to a power supply node;

a first current mirror having at least an output that is coupled to the current mirror circuit, wherein the first current mirror is an n-type current mirror; the first current mirror includes a first transistor and a second transistor; the first transistor has at least a gate, a drain, and a source; the second transistor has at least a gate, a drain, and a source; the gate of the first transistor is coupled to the gate of the second transistor, and wherein the drain of the second transistor is the output of the first current mirror; and a capacitor that is coupled between the gate of the second transistor and the power supply node such that the gate of the second transistor follows AC variations of a power supply voltage at the power supply node such that variations in the tail current due to the AC variations of the power supply voltage are approximately cancelled.

2. The circuit of claim 1, further comprising a resistive device that is coupled between the capacitor and the power supply node.

3. The circuit of claim 1, further comprising a differential pair that is arranged to receive the tail current.

4. The circuit of claim 1, wherein the current mirror circuit includes:

a second current mirror having at least an input and an output, wherein the second current mirror is operable to receive part or all of the input current at the input of the second current mirror;

a third current mirror having at least an input and a first output, wherein the input of the third current mirror is coupled to the output of the second current mirror, and wherein the third current mirror is operable to provide the tail current at the first output of the third current mirror.

5. The circuit of claim 4, wherein the second current mirror includes a third transistor and a fourth transistor; the third transistor has at least a gate, a drain, and a source; the fourth transistor has at least a gate, a drain, and a source; the drain of the third transistor is the input of the second current mirror; the drain of the fourth transistor is the output of the second current mirror; and wherein the drain of the second transistor is coupled to the drain of the third transistor.

6. The circuit of claim 4, wherein the output of the first current mirror is coupled to: the input of the second current mirror, the output of the second current mirror, or the output of the third current mirror.

7. The circuit of claim 6, wherein the third current mirror further includes a second output that is coupled to the input of the first current mirror.

8. The circuit of claim 7, wherein the second current mirror includes a third transistor and a fourth transistor; the third current mirror includes a fifth transistor, a sixth transistor, and a seventh transistor; the drain of the fifth transistor is the input of the third current mirror; the drain of the sixth transistor is the first output of the third current mirror; the drain of the seventh transistor is the second output of the third current mirror; and wherein the ratio of the fifth transistor to the seventh transistor and the ratio of the first transistor to the second transistor is such that a drain current of the second transistor is approximately $1/15^{th}$ of the drain current of the fifth transistor.

9. A low-drop out regulator circuit, comprising:

an error amplifier, including:

a differential pair that is operable to provide a differential pair output signal, and to receive a feedback voltage and a reference voltage;

a tail current source that is arranged to provide a tail current to the differential pair, wherein the tail current source includes:

a current mirror circuit that is operable to provide a tail current based, in part, on an input current, wherein the current mirror circuit is coupled to a power supply node;

a first current mirror having at least an output that is coupled to the current mirror circuit, wherein the first current mirror circuit includes a first transistor and a second transistor; the first transistor has at least a gate, a drain, and a source; the second transistor has at least a gate, a drain, and a source; the gate of the first transistor is coupled to the gate of the second transistor, and wherein the drain of the second transistor is the output of the first current mirror; and a capacitor that is coupled between the gate of the second transistor and the power supply node such that the gate of the second transistors follows AC variations of a power supply voltage at the power supply node such that variations in the tail current due to the AC variations of the power supply voltage are approximately cancelled; and an output stage that is operable to provide an error voltage based, in part, on the differential pair output signal.

10. The low-drop out regulator of claim 9, further comprising:

a pass transistor having at least a gate, a drain, and a source, wherein the source of the pass transistor is coupled to the power supply node; the pass transistor is arranged to receive the error voltage at the gate of the pass transistor; the pass transistor is arranged to provide a regulated output voltage at the drain of the pass transistor; and wherein the feedback voltage is based, at least in part, on the regulated output voltage.

11. The low drop-out regulator circuit of claim 9, wherein the low-drop out regulator circuit has a PSRR of at least 80 dB with a frequency from 100 Hertz to 10 kiloHertz, and a PSRR of at least 55 dB at 100 kiloHertz.

12. The low-drop out regulator of claim 9, wherein the tail current source further includes a resistive device that is coupled between the capacitor and the power supply node.

13. The low-drop out regulator of claim 12, wherein the error amplifier further includes second current mirror that is coupled to the differential pair, wherein the second current mirror includes a third transistor having at least a gate and a fourth transistor having at least a gate, the gate of the third transistor is coupled to the gate of the fourth transistor, and wherein the resistive device is a transistor having a gate that is coupled to the gate of the third transistor.

14. A method for power supply rejection, comprising:

receiving an input current;

employing a current mirror circuit to provide a tail current based, in part, on the input current, wherein the current mirror circuit is coupled to a power supply voltage;

employing a first n-type current mirror to divert current from the current mirror circuit; and capacitively coupling a gate of a transistor in the first n-type current mirror to the power supply voltage such that the gate of the transistors follows AC variations in the power supply voltage such that variations in the tail current due to the AC variations of the power supply voltage are approximately cancelled.

15. The method of claim 14, wherein the current mirror circuit includes a first current mirror and a second current mirror, the first current mirror circuit has an input that is operable to receive the input current and an output that is coupled to the input of the second current mirror, and wherein employing the first n-type current mirror to divert current from the current mirror circuit includes diverting current from the input of the second current mirror.

* * * * *

UNITED STATES PATENT AND TRADEMARK OFFICE

CERTIFICATE OF CORRECTION

PATENT NO. : 7,129,686 B1
APPLICATION NO. : 11/197052
DATED : October 31, 2006
INVENTOR(S) : Shengming Huang It is certified that error appears in the above-identified patent and that said Letters Patent is hereby corrected as shown below:

On the title page; item [56]:

Col. 1 (U.S. Patent Documents); Line 6; After "7,061,706" delete "B1" and insert -- B2 --, therefor.

Col. 1 (Other Publications); Line 1; Delete "Datatsheet," and insert -- Datasheet, --, therefor.

Sheet 1 of 2 Opposite Box 110 (Figure 1); Line 1; Delete "Cprsr" and insert -- Cpsr --, therefor.

Column 2; Line 62; After "Rc, Rf1," delete "Rf1," insert -- Rf2, --, therefor.

Column 2; Line 63; Delete "Rfil;" and insert -- R_fil; --, therefor.

Column 2; Line 67; Delete "Cbyp." And insert -- C_byp. --, therefor.

Signed and Sealed this

Fifteenth Day of May, 2007

JON W. DUDAS
*Director of the United States Patent and Trademark Office*